US006089369A

United States Patent [19]

Markey

[11] Patent Number: 6,089,369

[45] **Date of Patent: *Jul. 18, 2000**

[54] PARTITIONED FOLDING CARTON

[75] Inventor: Kevin Joseph Markey, Westminster, Md.

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,384

[22] Filed: Dec. 29, 1995

[51] Int. Cl.[7] ..... B65D 5/4805

[52] U.S. Cl. ..... 206/349; 206/77.1; 206/581; 229/120.09; 229/120.18; 229/162

[58] Field of Search ..... 206/77.1, 775–778, 206/781, 782, 256, 581, 349; 229/120.01, 120.011, 120.02–120.21, 162

[56] References Cited

U.S. PATENT DOCUMENTS

| | | | |
|---|---|---|---|
| 1,108,006 | 8/1914 | Rey | 206/256 |
| 1,112,752 | 10/1914 | Avellanal | 229/120.18 |
| 2,128,197 | 8/1938 | Weil | 229/120.18 |
| 2,744,622 | 5/1956 | Sparks | 206/777 |
| 2,888,185 | 5/1959 | Porter . | |
| 2,913,101 | 11/1959 | Daily . | |
| 3,047,204 | 7/1962 | Wolowicz . | |
| 3,135,453 | 6/1964 | Struble . | |
| 3,184,142 | 5/1965 | Rosenburg, Jr. | 229/120.18 |
| 3,235,163 | 2/1966 | Hennessey . | |
| 4,114,796 | 9/1978 | Voges . | |
| 4,159,765 | 7/1979 | Roccaforte | 206/782 |
| 4,260,059 | 4/1981 | Roccaforte . | |
| 4,342,417 | 8/1982 | Forbes, Jr. . | |
| 4,487,311 | 12/1984 | Lavery . | |
| 5,005,701 | 4/1991 | Dutcher | 206/775 |
| 5,465,834 | 11/1995 | Sieber et al. . | |

*Primary Examiner*—Jim Foster
*Attorney, Agent, or Firm*—Gerard J. McGowan, Jr.

[57] ABSTRACT

A carton particularly adapted to house both a container of cleansing agent and a washing implement. The carton of the invention includes front, rear and side panels and a compartment within the carton having at least three compartment walls which are free of attachment to, and do not form a part of, the carton panels. A particular advantage of the present carton is that it can be packed on automatic cartoning equipment.

14 Claims, 8 Drawing Sheets

PARTITIONED FOLDING CARTON

BACKGROUND OF THE INVENTION

Liquid cleansing formulations for use in the shower or bath have been gaining in popularity. However while these formulations may succeed as a substitute for the cleaning agents present in a traditional soap or mild surfactant bar, another component of washing is sometimes perceived to be missing. That is, the soap bar provides a washing implement which is absent when the liquid formulations are used. Moreover, it has been suggested that the lathering of liquid formulations could be improved.

A potential solution to the lack of a washing implement is the inclusion of a separate implement. Diamond mesh sponges or pouts such as that disclosed in Campagnoli, U.S. Pat. No. 5,144,744 have been suggested. Other types of sponges have also been mentioned. A problem presented by these implements is how to package them together with the cleaninsing agent conveniently, efficiently, and in such a way as to display them appealingly to the consumer.

Struble, U.S. Pat. No. 3,135,453 discloses a carton with a partition panel.

Daly, U.S. Pat. No. 2,913,101 is directed to carton which are said to be capable of displaying a pair of articles having substantially different dimensions.

Hennessey, U.S. Pat. No. 3,235,163 is directed to a rectangular, tubular carton which includes a partition forming extension including a glue flap.

Voges, U.S. Pat. No. 4,114,796 is directed to a carton having braced partitions.

Wolowicz, U.S. Pat. No. 3,047,204 is directed to a folding paperboard carton of the type commonly employed in the packaging of soap or detergent powders or flakes.

The Wolowicz patent is directed to preventing bowing of such cartons due to lateral pressure. The Wolowicz carton has an integral internal reinforcing cellular structure said to afford a maximum degree of resistance to outward bowing or other deformation of the carton.

Porter, U.S. Pat. No. 2,888,185 discloses a box having dividing partitions all made form a single length of material.

Sieber et al., U.S. Pat. No. 5,465,834 is directed to a folded box with a subdivided interior which includes a partition arrangement consisting of cardboard zones which are connected integrally to the folding box blank. Two models of different diameters and of different heights, the closing caps of which are located at the same height, can be safely accommodated in the folding box. A web provides the necessary height compensation.

Roccaforte, U.S. Pat. No. 4,260,059 discloses a multi sided container, preferably formed from a unitary blank, having an internal support formed of two hingedly connected divider panels receiving a fragile article such as a light bulb therebetween.

Lavery, U.S. Pat. No. 4,487,311 discloses a display carton fashioned from a one-piece blank of paperboard. The carton provides two product cells.

Forbes, U.S. Pat. No. 4,342,417 is directed a carton which contains a full length internal false wall located between two opposed carton sidewalls to form two compartments in the carton and a bridge panel for one of the compartments which is located between the false internal wall and an adjacent carton sidewall.

SUMMARY OF THE INVENTION

The invention is directed to a carton particularly adapted to house both a container for a cleansing agent and a washing implement. A particular advantage of the present carton is that it can be packed on automatic cartoning equipment, thereby eliminating intensive manual labor requirements associated with previous designs, which utilize extensive partitioning. In the present design the manual erecting, filling and sealing may be eliminated. The carton of the invention include s front, rear and side panels and a compartment within the carton having at least three compartment walls which are free of direct attachment to, and do not form a part of the carton panels.

The carton is formed from a unitary, integral blank. The blank includes panels for the front, rear and sides of the carton as well as a panel or flap for attachment of the compartment to the inside of the carton. The attachment flap or panel is itself attached to a front compartment wall, a side compartment wall and a rear compartment wall. A glue flap is attached to the rear compartment wall for adhering the rear compartment wall to the attachment flap or panel.

The walls of the inner compartment are not as wide as the panels of the carton so that the length and width of the inner compartment is less than that of the carton itself.

The carton and the compartment may be provided with display openings. The display openings of the compartment walls will be in at least partial alignment with the openings in the corresponding carton panels. This permits the contents of the carton to be readily viewed.

A particularly advantageous feature of the carton of the invention is that since three walls of the compartment a re not attached to the carton, the compartment can flex away from the front panel of the carton, reducing damage during shipment. This feature works particularly well when the interior of the carton exterior to the compartment contains a pouf or body sponge packed therein, which acts as a cushion behind the contents of the compartment. Typically, the compartment will contain a bottle of cleansing agent or possibly a carton of cleansing agent.

The carton may be made of paperboard or other known acceptable material.

For a more complete understanding of the above and other features and advantages of the invention, reference should be made to the following detailed description of the preferred embodiments and the accompanying drawings.

DETAILED DESCRIPTION OF THE INVENTION

Figure 1:
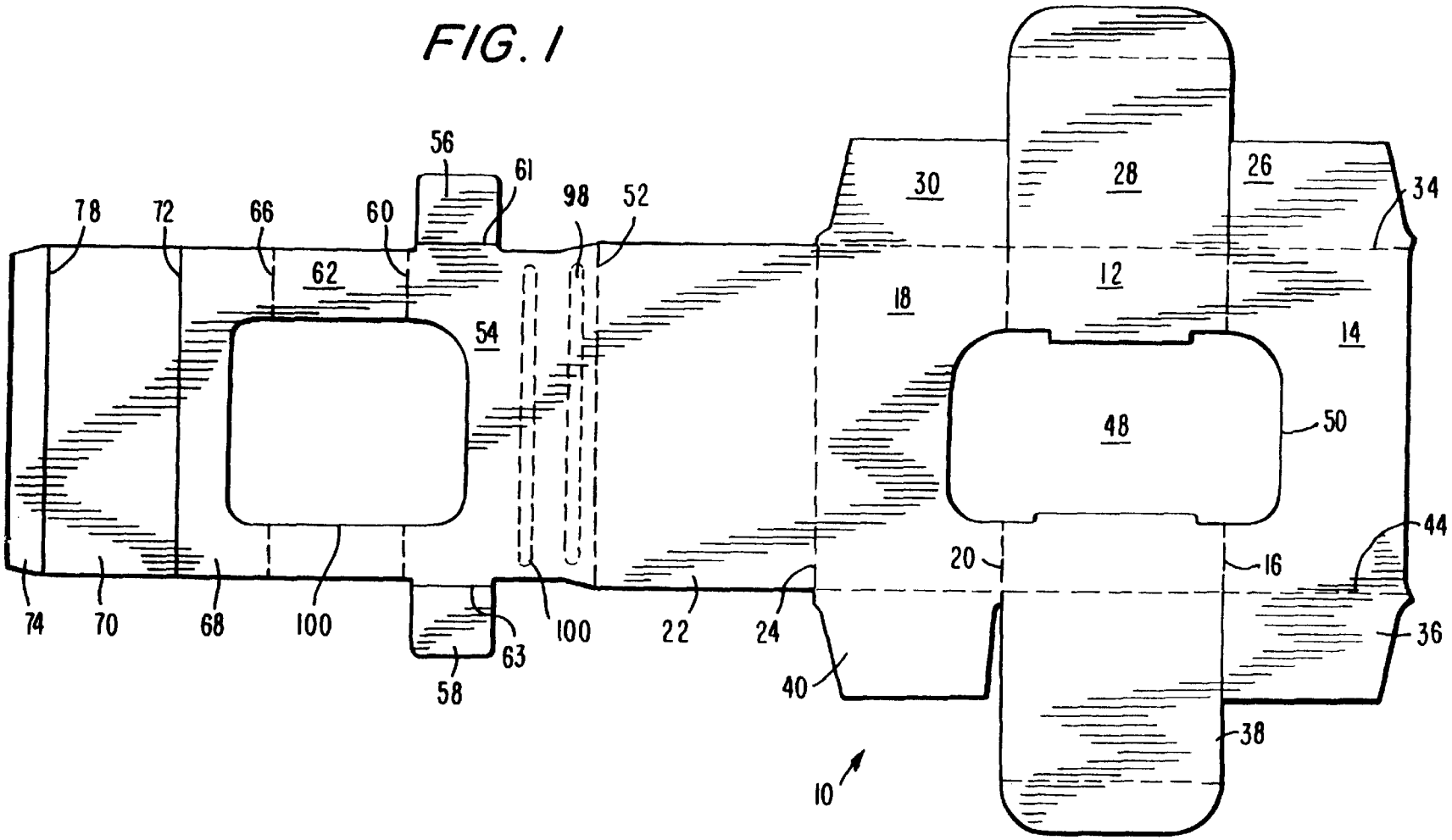
FIG. 1 is a top plan view of a blank useful in fabricating the carton of the invention.

Carton blank 10 comprises front panel 12 separated from first side panel 14 by transverse foldline 16. Second side panel 18 is separated from front panel 12 by transverse foldline 20. The foldline may comprise scorelines or other weakened lines in the material of which the blank is made. Rear panel 22 is separated from second side panel 18 by transverse foldline 24.

Top closure flaps 26, 28, and 30, are separated respectively from panel 14, 12 and 18 by longitudinal foldline 34. Bottom closure flap 36, 38 and 40 are separated respectively from panels 14,12 and 18 by longitudinal foldline 44.

Panels 14, 12 and 18 include display window 48 formed by cut lines 50.

Separated from rear panel 22 by transverse foldline 52 is proximal sidewall 54. Sidewall 54 includes top flap 56 and bottom flap 58 separated respectively from wall 54 by longitudinal foldline 61 and 63.

Separated from compartment sidewall 54 by transverse foldline 60 is front compartment wall 62. Separated from front compartment wall 62 by transverse foldline 66 is distal sidewall 68. Rear sidewall 70 is separated from distal sidewall 68 by foldline 72. Glue flap 74 extends from rear wall 70 and is separated therefrom by foldline 78.

The carton is formed by adhering glue flap 74 to the inside of proximal sidewall 54, thus squaring the compartment. The carton itself is then squared and the outer surface of proximal sidewall 54 is adhered to the inner surface of first side panel 14.

The top and bottom closure flaps may then be closed.

It will be appreciated that since compartment 90 is attached only at proximal sidewall 54, it is free to flex so as better to withstand the travails of shipping and other handling.

Figure 5:
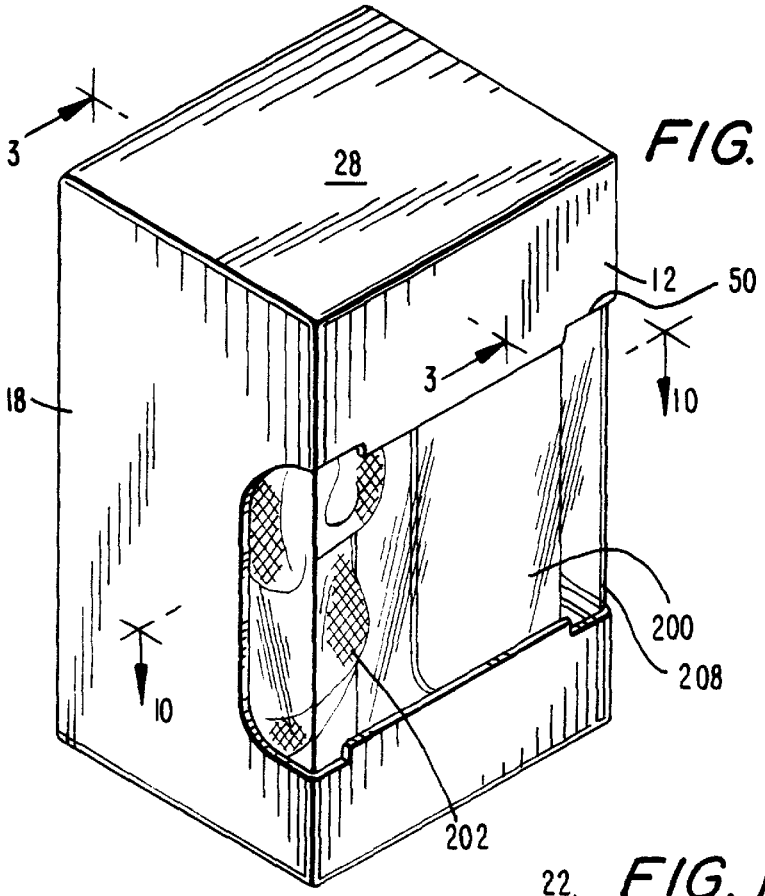
FIG. 5 is a perspective view of the erected carton of the invention containing a bottle of cleansing agent and a washing implement.
Figure 10:
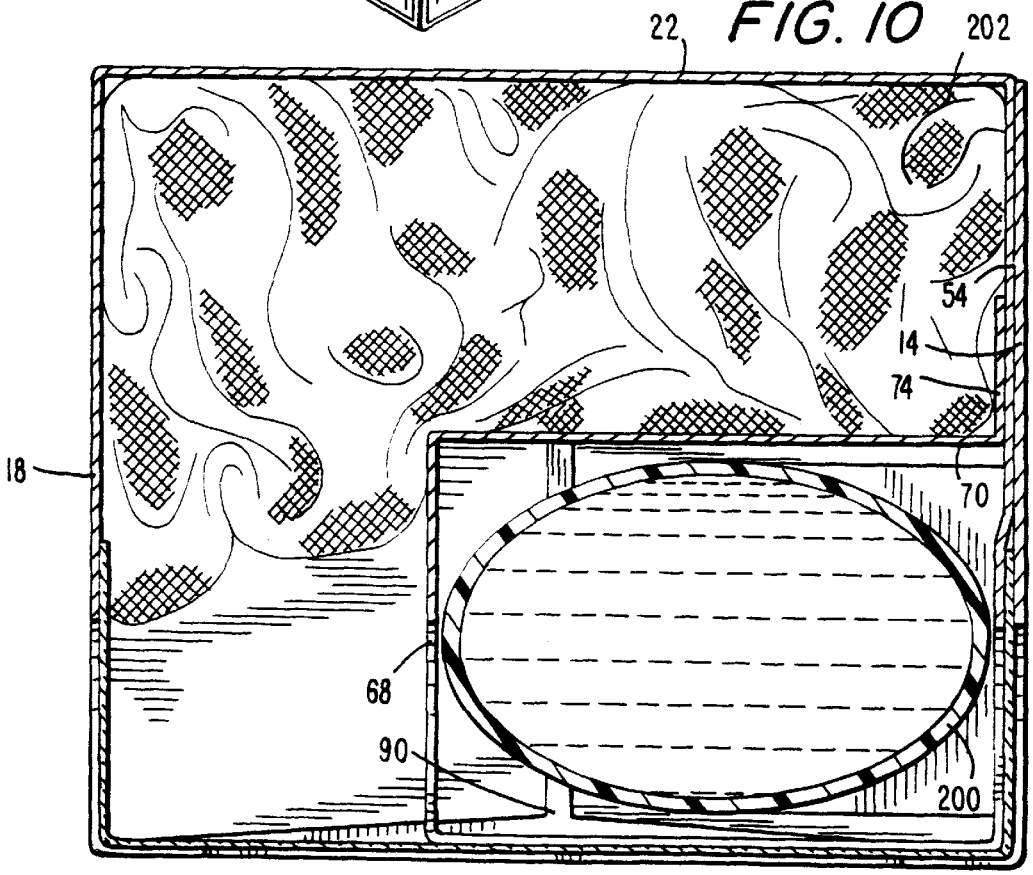
FIG. 10 is a cross section along the lines 10—10 of FIG. 5.
Figure 6:
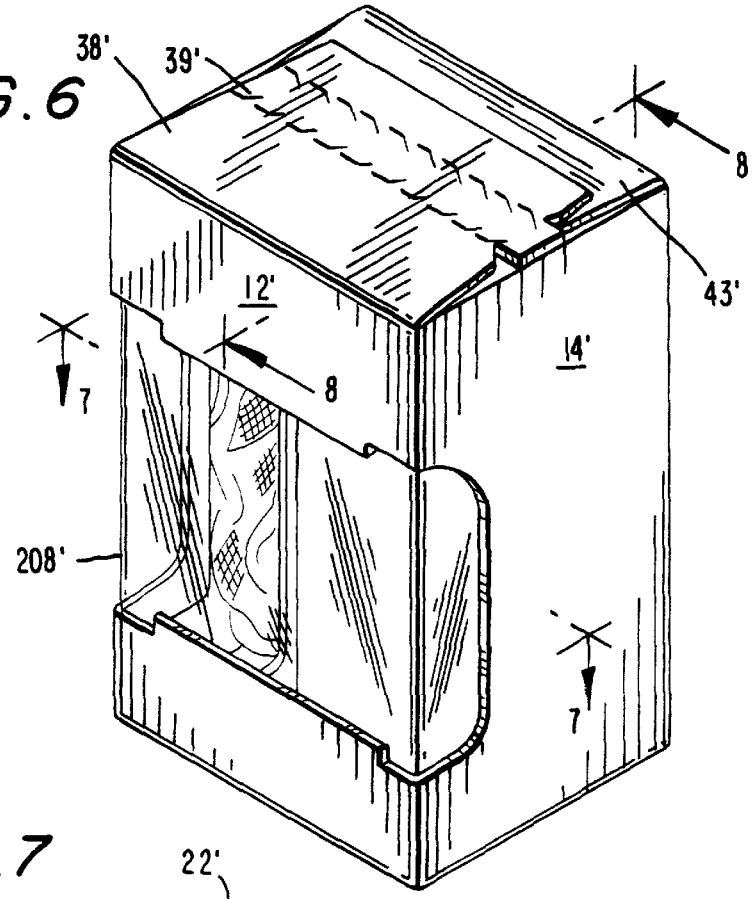
FIG. 6 is a perspective view of an alternate carton according to the invention.
Figure 7:
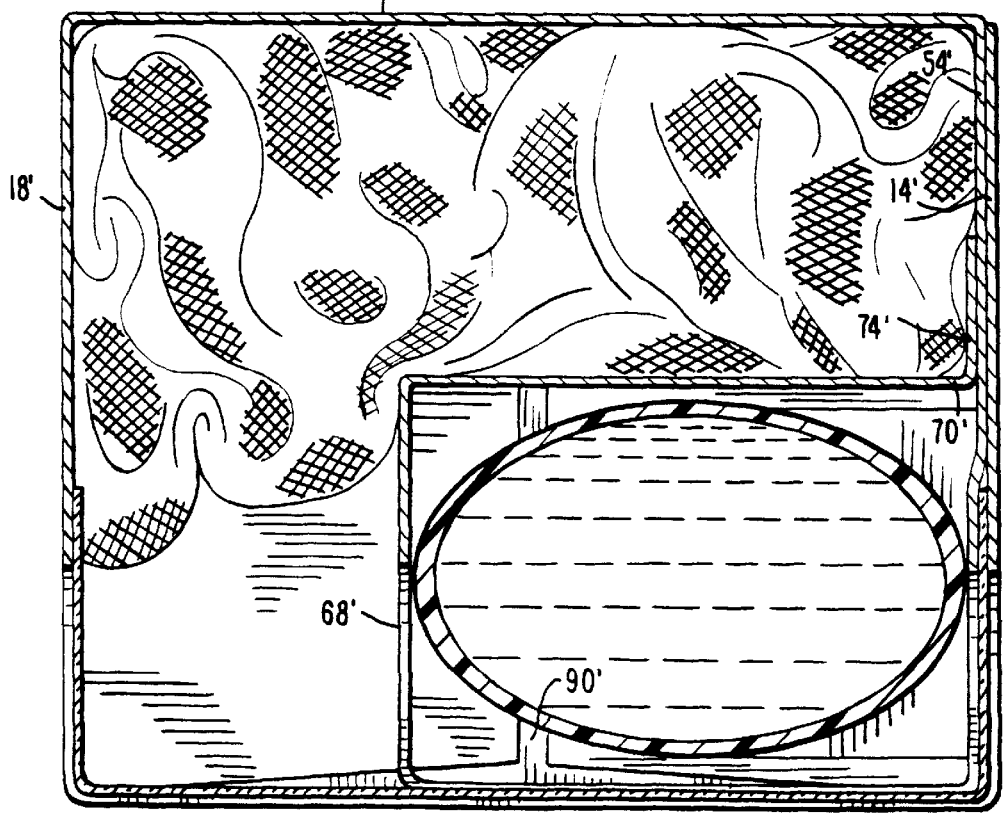
FIG. 7 is a cross section along the lines 7—7 of FIG. 6.
Figure 8:
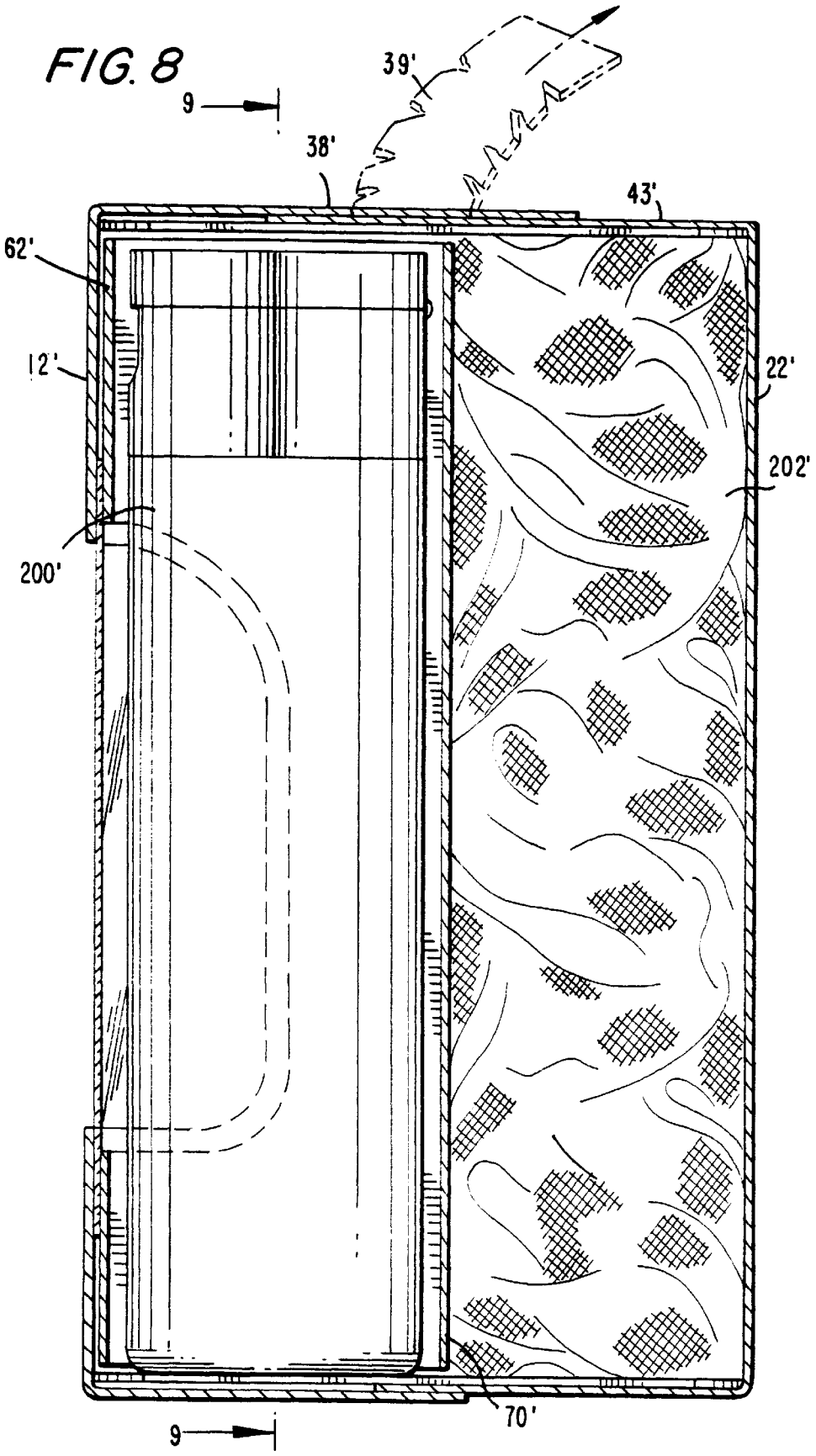
FIG. 8 is a cross section along the lines 8—8 of FIG. 6.
Figure 9:
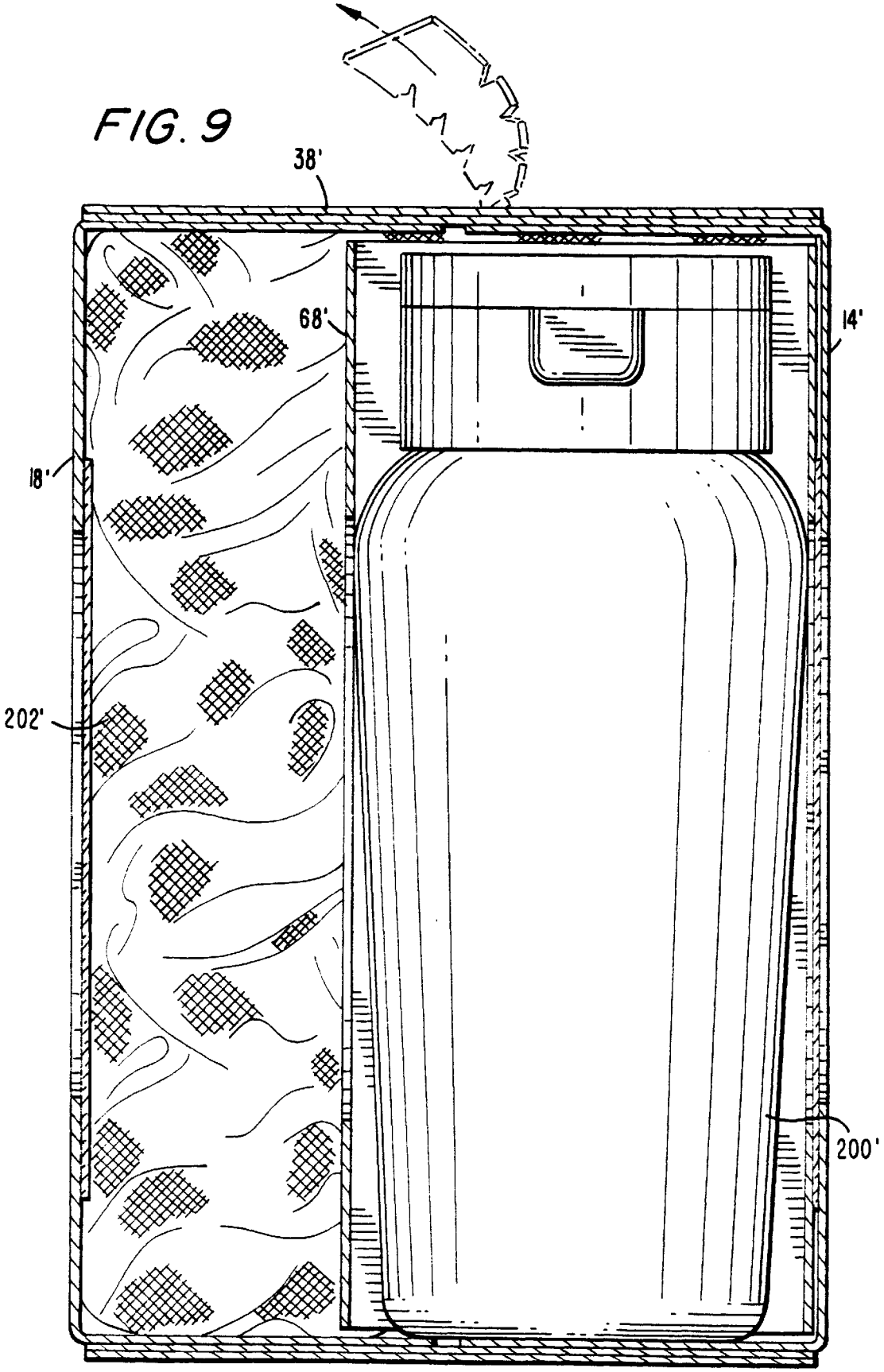
FIG. 9 is a cross section along the lines 9—9 of FIG. 8

As can be seen, display openings are present in the front panel and the side panels of the carton. These display openings are generally in alignment with display openings in the front wall and the sidewalls of the inner compartment, which form compartment window 100. This facilitates viewing of the contents by the consumer prior to purchase. In the erected carton flaps 56 and 58 are secured respectively to flaps 30 and 40, e.g. by glue or hot melt or other adhesive to enhance the attachment of the compartment to the carton. In FIG. 5, body wash container 200 is contained within compartment 100 and washing implement in the form of sponge or pouf 202 is disposed within the carton but outside the compartment.

If desired, the display openings in the carton and/or in the compartment may be covered by a transparent plastic material 208 to prevent exposure of the contents to the elements while still preserving the display function of the opening.

Advantageously glue lines 98, 101 are placed on the outer side of proximal sidewall 54 for gluing thereof to side panel 14. The "glue" may be an adhesive, such as hot melt or some other adhesive such as a chemical adhesive.

The body sponge may be a diamond mesh material such as that disclosed in Campagnoli, U.S. Pat. No. 5,144,744, which is incorporated by reference herein WO 95/00116.

The mesh material is preferably made of a polymer such as polyethylene and advantageously is somewhat resilient. The material may also be made of additional polymers of olefin monomers other than ethylene or of polyamides of polycarboxylic acids and polyamines. An alternative mesh material is nylon. The tubular netting mesh from which the links are formed are preferably strong, flexible polymeric materials. Extruded tubular mesh of this type have been used for the covering of meat and poultry carcasses. Such mesh materials are described in e.g. Sanford, U.S. Pat. No. 4,462,135, the disclosure of which is incorporated herein by reference.

Preferably, the sponge is used in conjunction with a liquid personal cleaning formulation which includes a surfactant and preferably a skin conditioning and moisturizing ingredient. Preferably the surfactant is a mild surfactant. Among the mild surfactants which may be used are cocamidopropyl betaine and sodium cocoylisethionate. Among other surfactants which may be used are soap and sodium laureth sulfate. Among the moisturizers which may be used are glycerine, mono, di and tri esters, mineral oil and silicone oil. A preferred moisturizer is the dimethicone emulsion sold as Dow Q2-1656, which is a 50% silicone emulsion. Thickeners such as ammonium sulfate and opacifiers such as mica/titanium dioxide may be used.

The washing implement may also be a reticulated, i.e., open-celled sponge. It will be appreciated that other arrangements of an internal compartment having at least three free sidewalls can be arrived at within the scope of the invention. For instance, the proximal sidewall of the compartment might be unitary with the rear wall of the compartment and the front wall of the compartment could attach to the side panel of the carton by means of a glue flap or a glue panel.

Figure 2:
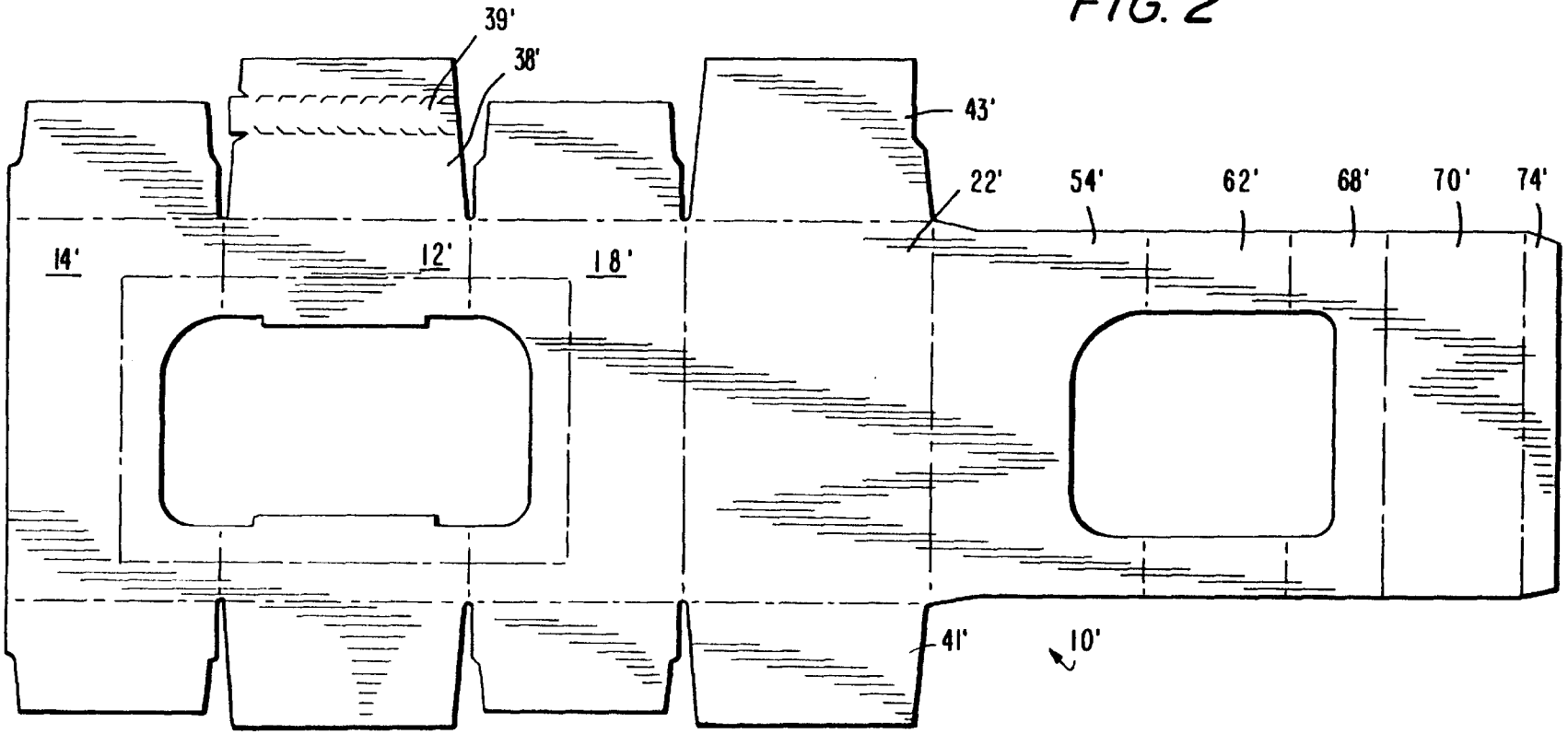
FIG. 2 is a bottom plan view of a blank useful in fabricating an alternate carton according to the invention.
Figure 3:
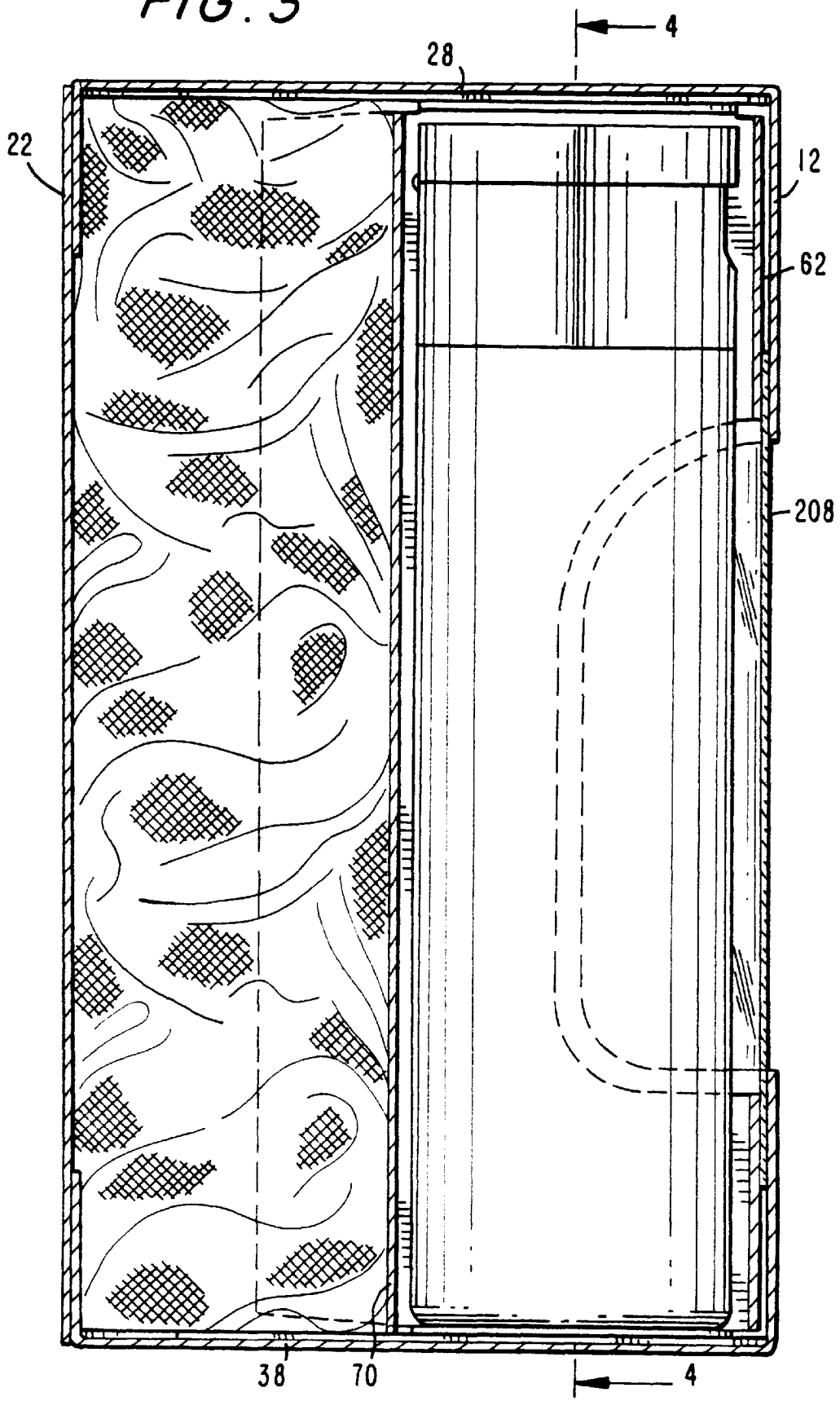
FIG. 3 is a cross section along the lines 3—3 of FIG. 5.
Figure 4:
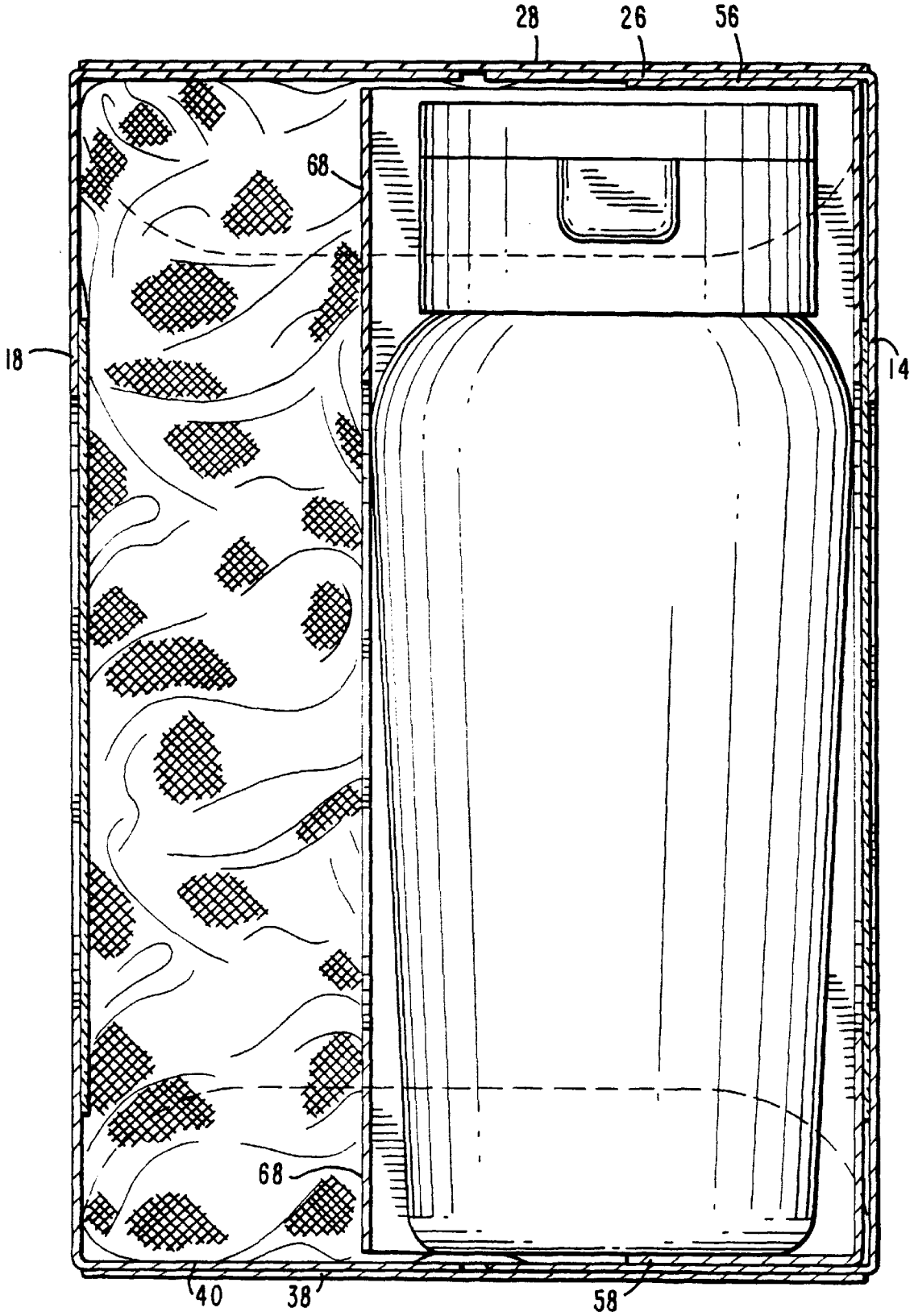
FIG. 4 is a cross section along the lines 4—4 of FIG. 3.

In the alternate arrangement shown in FIGS. 2–9, top flap 38' includes a tear strip 39' and rear top closure flaps 41' and 43' are included. The closure flaps are glued together, instead of tucked as in FIG. 1. The carton formed from blank 10' is opened by pulling on the tear strip. Other features corresponding generally with those of the first embodiment are denoted by prime numbers. It should be noted that FIG. 2 shows the unprinted (inside) of the blank whereas FIG. 1 shows the printed (outside) side of the blank.

It should be understood of course that the specific forms of the invention herein illustrated or described are intended to be representative only as certain changes may be made therein without departing form the clear teachings of the disclosure. Accordingly reference should be made to the following appended claims in determining the full scope of the invention.

What is claimed is:

1. A carton comprising a front panel, a first side panel adjacent thereto, a rear panel adjacent said first side panel and opposite said front panel and a second side panel between said front and rear panels and opposite said first side panel, a compartment containing an implement within said carton the interior of which is defined by at least three compartment walls, said interior compartment walls including a first wall, a second wall adjacent said first wall, and a third wall adjacent said second wall and opposite said first wall, said compartment further comprising means indirectly attaching at least one of walls to a panel of said carton, at least three of said interior compartment walls being free of direct attachment to and not forming a part of said front, rear and first and second side panels, said indirect attachment means being disposed such that said compartment is free to flex away from said front panel, said means comprising a wall or flap adhered to one of said panels of said carton, at least one of said panels including a display opening and at least one of said walls including a display opening at least partially aligned with said panel display opening.

2. The carton according to claim 1 further comprising top and bottom closure flaps.

3. The carton according to claim 1 wherein said compartment first wall is a front wall, said second wall is a first side wall adjacent said front wall, and said third wall is a rear wall adjacent said first side wall and opposite said front wall, wherein said compartment indirect attachment means indirectly attaches at least one of said front and rear walls to a panel of said carton.

4. The carton according to claim 3 wherein said indirect attachment means comprises a glue flap.

5. The carton according to claim 3 wherein said indirect attachment means comprises a second compartment side wall between said front and rear walls and opposite said first side wall and glued to one of said carton panels.

6. The carton according to claim 3 wherein said front panel includes said display opening and said front wall includes a display opening at least partially aligned with said front panel display opening.

7. The carton according to claim 5 wherein said first and second side panels include display openings and said first and second side walls include display openings at least partially aligned with said first and second side panel display openings.

8. The carton according to claim 5 wherein said second side wall is separated from one of said front or rear panels by a fold line and adhered to one of said first or second side panels.

9. The carton according to claim 3 wherein said indirect attachment means further comprises a glue flap adhered to one of said carton panels or compartment walls.

10. The carton according to claim 9 wherein said compartment walls includes first and second side walls and said glue flap is adhered to said second side wall.

11. The carton according to claim 10 wherein said compartment glue flap is separated from said compartment rear wall by a fold line.

12. The carton according to claim 1 wherein each of said carton compartment walls extends parallel to one or more corresponding carton panels and none of the compartment walls extends the full distance of its corresponding panel from one adjacent panel to the other.

13. The carton according to claim 1 wherein said compartment walls comprise two pairs of parallel sides, each pair being perpendicular to the other, at least three compartment walls being free of direct attachment to and not comprising a part of said front, rear, and first and second side panels.

14. A carton comprising a front panel, a first side panel adjacent thereto, a rear panel adjacent said first side panel and opposite said front panel and a second side panel between said front and rear panels and opposite said first side panel, a compartment within said carton the interior of which is defined by at least three compartment walls, said interior compartment walls including a first wall, a second wall adjacent said first wall, and a third wall adjacent said second wall and opposite said first wall, said compartment further comprising means indirectly attaching at least one of said walls to a panel of said carton, at least three of said interior compartment walls being free of direct attachment to and not forming a part of said front, rear and first and second side panels, said indirect attachment means being disposed such that said compartment is free to flex away from said front panel, said compartment first wall being a front wall, said second wall being a first side wall adjacent said front wall, and said third wall being a rear wall adjacent said first side wall and opposite said front wall, said indirect attachment means indirectly attaching at least one of said front and rear walls to a panel of said carton, said indirect attachment means comprising a second compartment side wall between said front and rear walls and opposite said first side wall and glued to one of said carton panels, said first and second side panels including display openings and said first and second side walls including display openings at least partially aligned with said first and second side panel display openings.

* * * * *